US011927092B2

(12) United States Patent
Holly et al.

(10) Patent No.: US 11,927,092 B2
(45) Date of Patent: Mar. 12, 2024

(54) DOWNHOLE BARRIER AND ISOLATION MONITORING SYSTEM

(71) Applicant: Halliburton Energy Services, Inc., Houston, TX (US)

(72) Inventors: Mark S. Holly, The Colony, TX (US); Kevin Dwain Fink, McKinney, TX (US); Celso Max Trujillo, Jr., Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 146 days.

(21) Appl. No.: 16/624,680

(22) PCT Filed: Feb. 26, 2019

(86) PCT No.: PCT/US2019/019608
§ 371 (c)(1),
(2) Date: Dec. 19, 2019

(87) PCT Pub. No.: WO2020/176077
PCT Pub. Date: Sep. 3, 2020

(65) Prior Publication Data

US 2021/0355818 A1 Nov. 18, 2021

(51) Int. Cl.
*E21B 47/12* (2012.01)
*E21B 23/06* (2006.01)
(Continued)

(52) U.S. Cl.
CPC ..... *E21B 47/12* (2013.01); *E21B 23/06* (2013.01); *E21B 47/01* (2013.01); *E21B 47/06* (2013.01)

(58) Field of Classification Search
CPC ..... E21B 23/06; E21B 47/12; E21B 47/01; E21B 47/06; E21B 33/12
See application file for complete search history.

(56) References Cited

U.S. PATENT DOCUMENTS 6,727,827 B1 * 4/2004 Edwards ..... E21B 47/13 340/854.9
6,865,934 B2 3/2005 Schultz et al.
(Continued)

FOREIGN PATENT DOCUMENTS

CA 2344729 11/2004
WO 2010058313 5/2010

OTHER PUBLICATIONS

International Application No. PCT/US2019/019608, "International Search Report and Written Opinion", dated Nov. 25, 2019, 13 pages.

*Primary Examiner* — Dany E Akakpo
(74) *Attorney, Agent, or Firm* — Kilpatrick Townsend & Stockton LLP

(57) ABSTRACT

A status of an isolation barrier can be determined by comparing data collected by a sensor below the isolation barrier to data collected by a sensor above the isolation barrier. A sensor assembly can be coupled to an isolation barrier assembly downhole from the isolation barrier assembly for collecting data related to a characteristic of the wellbore. The sensor assembly can transmit the data collected to a tool positioned up-hole from the isolation barrier. The tool can transmit the data to a surface of the wellbore. The sensor assembly can be powered by a battery pack or via a connection to a downhole tool that supplies the power to the sensor assembly. The downhole tool that receives the data from the sensor assembly (and optionally provides power to the sensor assembly) can be inserted and removed from the wellbore over the lifetime of the well.

15 Claims, 4 Drawing Sheets

(51) Int. Cl.
*E21B 47/01* (2012.01)
*E21B 47/06* (2012.01)

(56) References Cited

U.S. PATENT DOCUMENTS

| | | | | |
|---|---|---|---|---|
| 7,073,580 | B2 | 7/2006 | Wilson et al. | |
| 8,733,458 | B2 * | 5/2014 | Gambier | E21B 23/06 166/387 |
| 2002/0020525 | A1 * | 2/2002 | Willauer | E21B 47/017 166/187 |
| 2004/0060696 | A1 | 4/2004 | Schultz et al. | |
| 2004/0169367 | A1 | 9/2004 | Sutherland et al. | |
| 2012/0175135 | A1 * | 7/2012 | Dyer | E21B 47/01 166/387 |
| 2013/0056200 | A1 | 3/2013 | Martinez et al. | |
| 2014/0311736 | A1 | 10/2014 | Pipchuk et al. | |
| 2015/0204155 | A1 * | 7/2015 | Patel | E21B 43/04 166/360 |
| 2015/0354339 | A1 * | 12/2015 | Handy | E21B 23/06 166/381 |
| 2018/0051555 | A1 * | 2/2018 | Marvel | E21B 47/00 |

* cited by examiner

DOWNHOLE BARRIER AND ISOLATION MONITORING SYSTEM

TECHNICAL FIELD

The present disclosure relates generally to assemblies for use in a subterranean wellbore and their use, and more particularly (although not necessarily exclusively), to assemblies and methods for monitoring conditions surrounding an isolation device for evaluating the performance of the isolation device.

BACKGROUND

Various devices can be utilized in a well traversing a hydrocarbon-bearing subterranean formation. For example, an isolation or barrier device can be installed or set along tubing string in the well. The isolation device may be set from the surface, for example via a force applied from the surface to the support device. From the surface it can be difficult to determine if a seal or isolation was created properly.

DETAILED DESCRIPTION

Certain aspects and features of the present disclosure relate to a system including a sensor assembly or package positioned below an isolation barrier. Following setting and sealing of the isolation barrier, a sensor of the sensor assembly may be activated via wireless telemetry by a tool positioned above the isolation barrier. The tool can instruct the sensor assembly to begin collecting data and transmitting that data to the tool. The data collected by the sensor assembly can be compared with data collected above the isolation barrier to verify the isolation seal of the isolation barrier. Data may be collected above the isolation barrier by a sensor positioned on a tool or on a casing or other tubing string, for example but not limited to on the isolation barrier assembly. In some aspects, the isolation barrier may be deployed and set via slickline, wireline, or other conveyance. The tool for communicating with the sensor assembly positioned below the isolation barrier can be run downhole in the same run as the barrier being deployed and set. The tool may receive the data from the sensor assembly and transmit that data to the surface in real time for evaluation. The data may be transmitted from the tool to the surface via telemetry.

In some aspects the sensor assembly is powered by a power source with a limited lifespan, for example but not limited to batteries. In some aspects, the sensor assembly may be powered by a power source that is positioned above the isolation barrier such that the power source may be recharged or replaced without interfering with the barrier valve. The isolation barrier may include a thru-wired kit that would connect the power source above the isolation barrier to the sensor assembly below the isolation barrier for powering the sensor assembly. In some aspects, the power source positioned above the isolation barrier (e.g. a battery) may be removed and replaced via slickline or wireline to extend the service of the sensor package below the isolation barrier.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
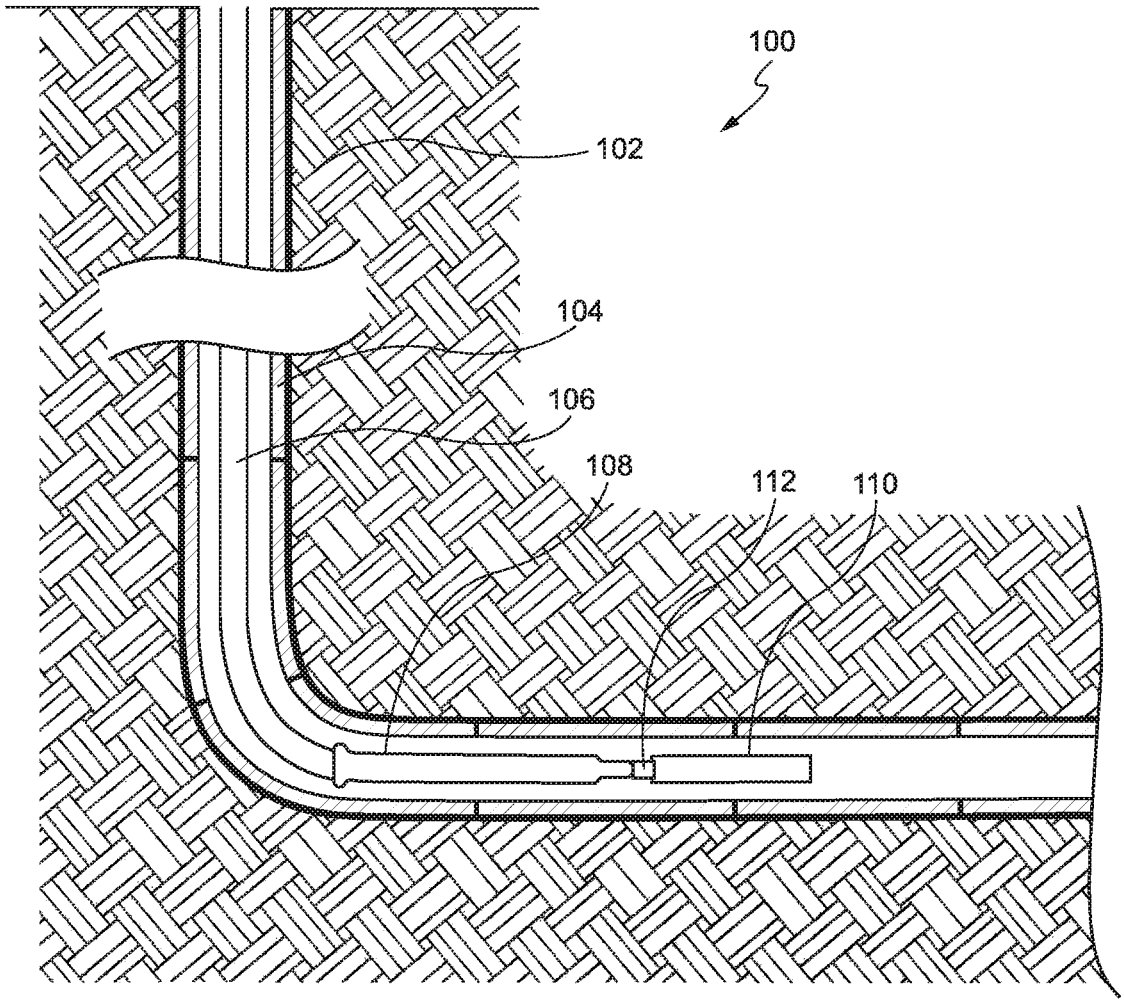
FIG. 1 is a schematic illustration of a wellbore system including an isolation barrier assembly, a sensor assembly, and a downhole tool, according to an aspect of the present disclosure.

FIG. 1 depicts by schematic illustration an example of a well system 100 that includes a bore that is a wellbore 102 extending through various earth strata. A casing string 104 may extend downhole within the wellbore 102. The casing string 104 may remain in the wellbore 102 for the life of the well. A downhole tool, for example running tool 106 may extend downhole within the casing string 104. The running tool 106 may be coupled to an isolation barrier assembly 108, for example bridge plug assembly, a crown plug assembly, a packer assembly, or other suitable isolation barrier assemblies. The isolation barrier assembly 108 may be coupled to a sensor assembly 110 via an adaptor 112. The running tool 106 may position the isolation barrier assembly 108 within the casing string 104 and force the isolation barrier assembly 108 into a coupled engagement with the sensor assembly 110 via the adaptor 112.

Figure 2:
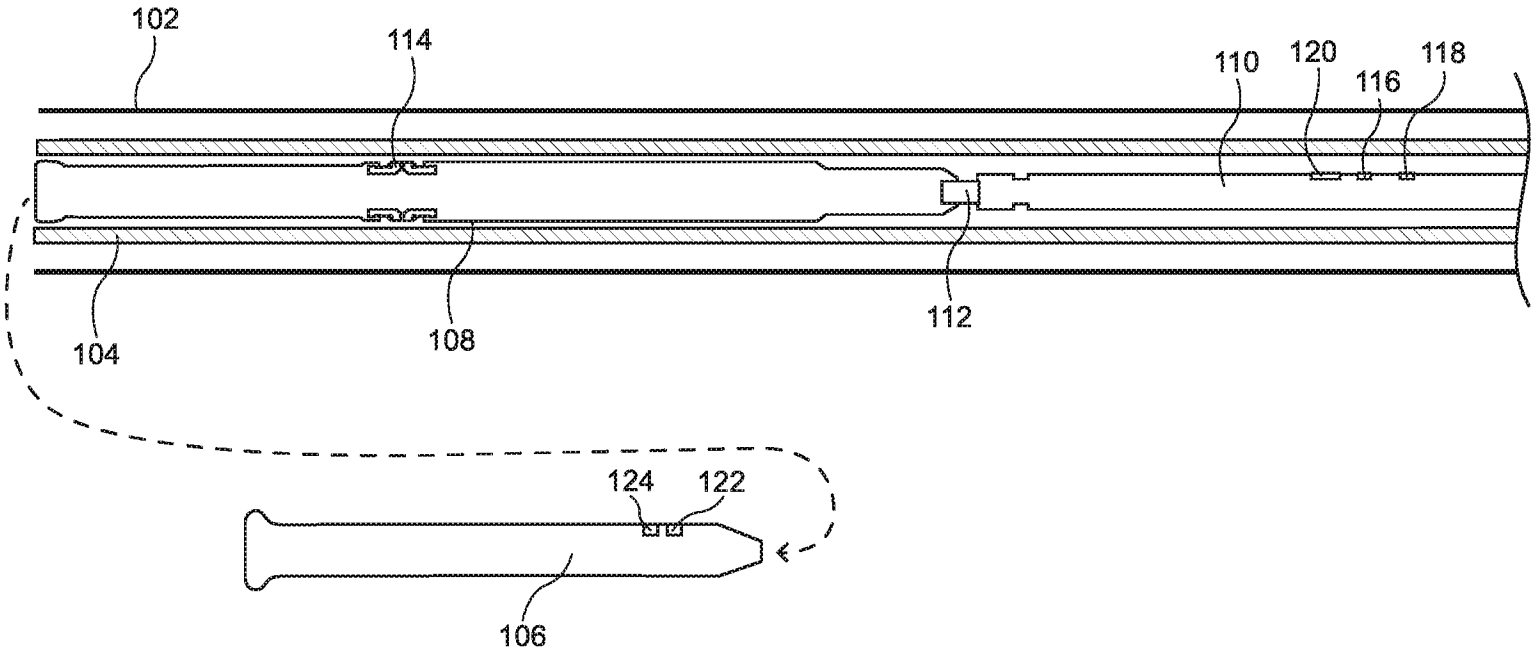
FIG. 2 is a cross-sectional side view the wellbore system of FIG. 1, according to an aspect of the present disclosure.

FIG. 2 depicts a cross-sectional side view of the isolation barrier assembly 108, shown in FIG. 2 as a bridge plug assembly, coupled to a sensor assembly, shown as the sensor assembly 110 via the adaptor 112. The running tool 106 is shown in FIG. 2 decoupled from the isolation barrier assembly 108. FIG. 2 further depicts a plug 114 of the isolation barrier assembly 108 being in a set position. The plug 114 having been set, the running tool 106 may be uncoupled from the isolation barrier assembly 108. The running tool 106 may remain within the casing string 104 in the wellbore 102 uncoupled from the isolation barrier assembly 108 as referenced further below. In some aspects, the running tool 106 may remain coupled to the isolation barrier assembly 108 after the plug 114 has been set.

As shown in FIGS. 1 and 2, the sensor assembly 110 may be positioned below the plug 114 of the isolation barrier assembly 108. The sensor assembly 110 may include a sensor 116, a wireless communications module 118, and a power source 120. In some aspects, the sensor 116 may be a pressure sensor, a temperature sensor, or another type of sensor for monitoring the environment below the isolation barrier assembly 108. The sensor 116 may monitor a characteristic of the environment that may be indicative of the function of the isolation barrier assembly 108, including for example if the isolation barrier assembly 108 has formed a proper seal. The sensor 116 may transmit data to a downhole tool (e.g. the running tool 106 shown in FIG. 1 decoupled from the isolation barrier assembly 108) via the wireless communications module 118. The wireless communications module 118 may include one or more of a wireless receiver, a wireless transceiver, or a wireless transmitter. The running tool 106 may include a wireless communications module 122 for receiving the data from the sensor 116. The running tool 106 may transmit the data received from the sensor to the surface, for example via a wired or wireless communication means 124 (e.g. via wireline, slickline, acoustic telemetry or other suitable communications means). The sensor assembly 110 may transmit data across the isolation barrier assembly 108 that includes plugs, a packer, a valve, cement, resin, or other features or materials.

In some aspects of the present disclosure the sensor assembly 110 may be capable of being powered via a tool positioned above the isolation barrier assembly 108, for example via the running tool 106 or another downhole tool. Thus the sensor assembly 110 can be used over a long period of time given it may be powered by the running tool 106 or another downhole tool. The data collected by the sensor 116 below the plug 114 can be compared to data collected by a sensor above the plug 114, including for example, a sensor positioned on the running tool 106 or on the isolation barrier assembly 108 above the plug 114. The performance of the seal provided by the isolation barrier assembly 108 can be determined based on the comparison between the data collected above and below the plug 114. For example, the integrity of the seal of the plug 114 can be determined by comparing the characteristics of the environment collected above the plug 114 and below the plug 114.

The running tool 106 can decouple but remain above the plug 114 and can transmit data to and receive data from the sensor assembly 110. Data from the sensor assembly 110 may be transmitted from the running tool 106 (or other suitable downhole tool) the surface of the wellbore, for example via acoustic telemetry or other suitable means. In some aspects, the running tool 106 may be removed from the wellbore and a different downhole tool may be inserted into the wellbore for receiving data from the sensor assembly 110 and transmitting data to the surface. In some aspects the running tool 106 or another downhole tool may transmit instructions to the sensor assembly 110, for example providing a schedule for the sensor 116 to turn on, off, and transmit data, provide a software update, or other data transmission to the sensor assembly 110. In some aspects the sensor assembly 110 may receive other data for optimizing the function of the sensor assembly 110. The sensor assembly 110 for example may be turned off until a tool, e.g. running tool 106 or other suitable downhole tools, are positioned downhole and transmit an instruction to the sensor assembly 110 to turn on, collect data, and transmit it to the tool.

Figure 3:
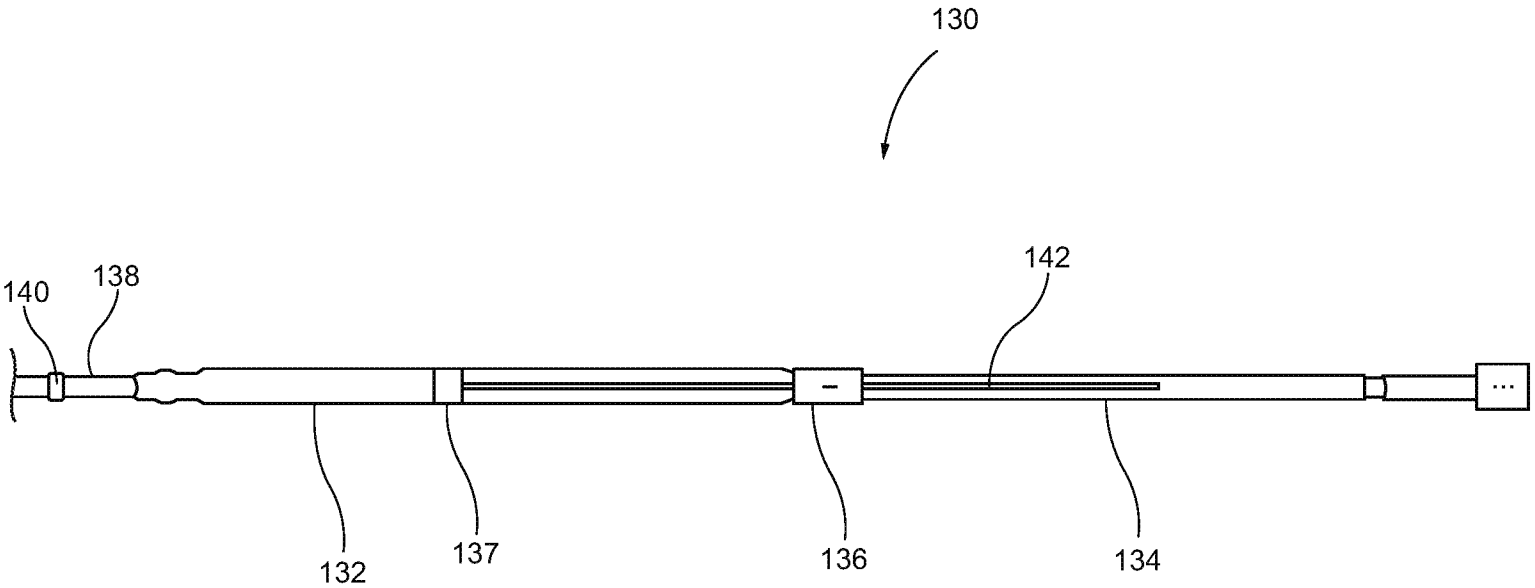
FIG. 3 is a cross-sectional side view of a system including a downhole tool, a sensor assembly, and an isolation barrier assembly, according to an aspect of the present disclosure.

FIG. 3 depicts a system 130 including an isolation barrier assembly 132 coupled to a sensor assembly 134 via an adaptor 136. The isolation barrier assembly 132 may include connector 137 that may receive a tool, for example downhole tool 138. The connector 137 may include a wet-stab connector or other suitable connector. The downhole tool 138 includes a power source 140, for example the downhole tool 138 may be powered by a battery pack, or via slickline or wireline cable. The power source 140 may be coupled to and power the sensor assembly 134 via feed-thru lines 142 that extend from the connector 137 to the sensor assembly 134 via an interior region of the sensor assembly 134. The feed-thru lines 142 may extend through the adaptor 136. Thus, the downhole tool 138 may couple to the isolation barrier assembly 132 and may power the sensor assembly 134 via feed-thru lines 142 that transmit power from the power source 140 to the sensor assembly 134. The sensor assembly 134 can include the same features and function in substantially the same way as the sensor assembly 110 described with reference to FIG. 2. The sensor assembly 134 can thus be powered over a long period of time via the downhole tool 138 which may be inserted and removed from the wellbore at various time period during the lifetime of the well. The downhole tool 138 can receive data from the sensor assembly 134 and transmit the data to the surface, for example via slickline or wireline.

Figure 4:
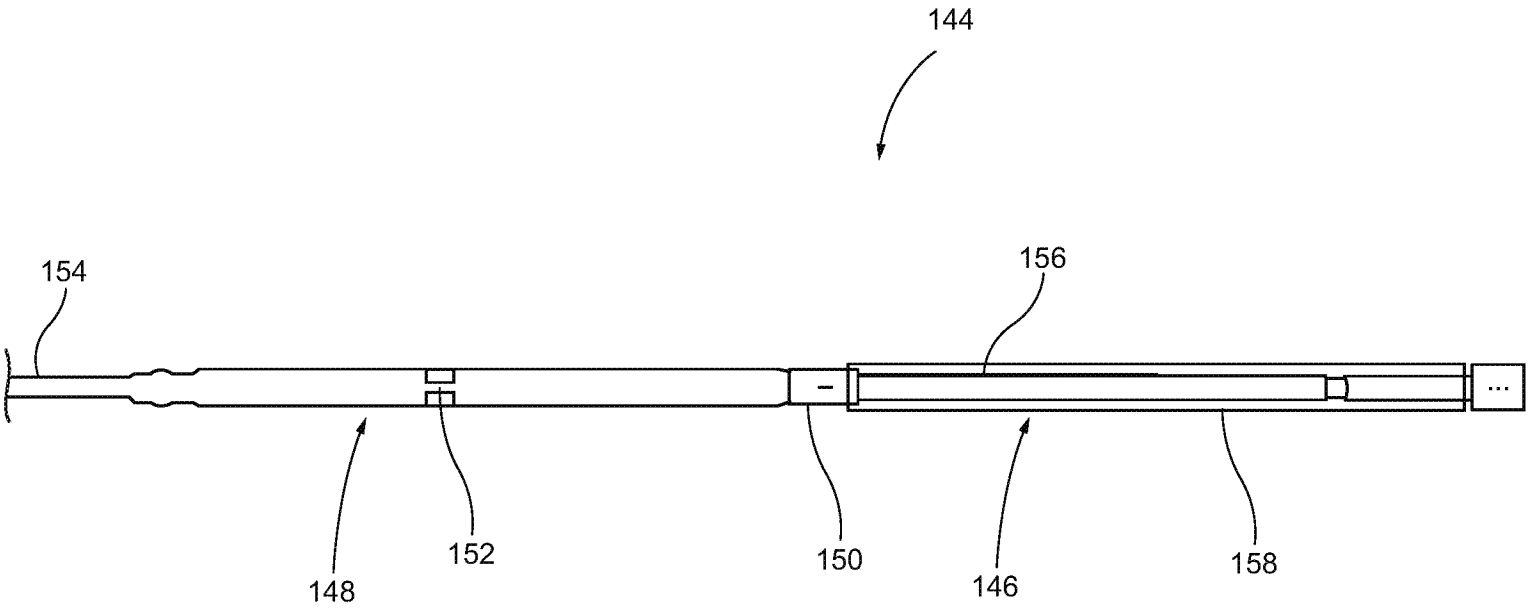
FIG. 4 is a cross-sectional side view of another system including a downhole tool, a sensor assembly, and an isolation barrier assembly, according to an aspect of the present disclosure.

FIG. 4 depicts another system 144 for powering a sensor assembly 146 coupled to and positioned below an isolation barrier assembly 148. The sensor assembly 146 can include the same features and function in substantially the same way as the sensor assembly 110 described with reference to FIG. 2. The sensor assembly 146 is coupled to the isolation barrier assembly 148 via an adaptor 150. The isolation barrier assembly 148 includes a connector 152 that may couple to a downhole tool 154. The connector 152 can include a wet-stab connector or other suitable connector. The downhole tool 154 may be powered via a battery pack, or via power lines (e.g., wireline or slickline). Power from the downhole tool 154 can be transmitted from the connector 152 to the sensor assembly 146 via feed-thru lines 156. The feed-thru lines 156 can be positioned on an outer surface of the sensor assembly 146. A housing 158 may be positioned over the feed-thru lines 156 to protect the feed-thru lines 156. The feed-thru lines 156 can be coupled to the adaptor 150 which in turn may be connected to the connector 152 for transmitting the power from the downhole tool 154 to the sensor assembly 146.

Example 1 is a wellbore system for use downhole in a wellbore, the wellbore system comprising: a downhole tool; an isolation barrier assembly; a sensor assembly coupled to the isolation barrier assembly via an adaptor, wherein the isolation barrier assembly is positionable downhole between the downhole tool and the sensor assembly, and wherein the sensor assembly is in wireless communication with the downhole tool.

Example 2. The wellbore system of example 1, wherein the downhole tool is a running tool for running the isolation barrier assembly downhole and setting the isolation barrier assembly.

Example 3 is the wellbore system of examples 1-2, wherein the sensor assembly includes a battery pack for powering the sensor assembly.

Example 4 is the wellbore system of examples 1-3, wherein the isolation barrier assembly includes a connector for coupling to a downhole tool for supplying power to the sensor assembly via a power coupling connection.

Example 5 is the wellbore system of example 4, wherein the connector is coupled to thru-lines for transmitting the power from the downhole tool to the sensor assembly.

Example 6 is the wellbore system of examples 1-5, wherein the downhole tool is in wireless communication with the sensor assembly for transmitting instructions to the sensor assembly.

Example 7 is the wellbore system of examples 1-6, wherein the sensor assembly includes a sensor for monitoring pressure.

Example 8 is the wellbore system of examples 1-7, wherein the downhole tool includes a wired communication link for transmitting data received from the sensor assembly to a surface of the wellbore.

Example 9 is the wellbore system of example 8, wherein the downhole tool includes wireline or slickline.

Example 10 is a method for determining a performance status of an isolation barrier assembly downhole in a wellbore comprising: positioning a sensor assembly downhole, the sensor assembly coupled to the isolation barrier assembly and positioned downhole to the isolation barrier assembly collecting, via the sensor assembly, data related to a characteristic of the wellbore downhole from the isolation barrier assembly; and transmitting the data collected by the sensor assembly to a downhole tool positioned up-hole to the isolation barrier assembly.

Example 11 is the method for determining a performance status of an isolation barrier assembly downhole in a wellbore of example 10, further comprising: transmitting the data related to the characteristic of the wellbore from the downhole tool to a surface of the wellbore.

Example 12 is the method for determining a performance status of an isolation barrier assembly downhole in a wellbore of example 11, wherein the step of transmitting the data related to the characteristic of the wellbore from the downhole tool to a surface of the wellbore further comprising transmitting the data via a wired communication link including slickline or wireline.

Example 13 is the method for determining a performance status of an isolation barrier assembly downhole in a wellbore of example 10-12, further comprising: transmitting power from the downhole tool to the sensor assembly via a connector within the isolation barrier assembly to which the downhole tool coupled.

Example 14 is the method for determining a performance status of an isolation barrier assembly downhole in a wellbore of example 13, wherein the step of transmitting power from the downhole tool to the sensor assembly via the connector within the isolation barrier assembly to which the downhole tool coupled further comprises transmitting power from the downhole tool to the sensor assembly via a wet-stab connector.

Example 15 is the method for determining a performance status of an isolation barrier assembly downhole in a wellbore of example 13, wherein the step of transmitting power from the downhole tool to the sensor assembly via the connector within the isolation barrier assembly to which the downhole tool coupled further comprises transmitting power from the downhole tool to the sensor assembly via a plurality of thru-wires positioned within an inner region of the sensor assembly.

Example 16 is the method for determining a performance status of an isolation barrier assembly downhole in a wellbore of example 13, wherein the step of transmitting power from the downhole tool to the sensor assembly via the connector within the isolation barrier assembly to which the downhole tool coupled further comprises transmitting power from the downhole tool to the sensor assembly via a plurality of thru-wires positioned on an outer surface of the sensor assembly and covered by a housing.

Example 17 is the method for determining a performance status of an isolation barrier assembly downhole in a wellbore of examples 11-16, further comprising: transmitting data wirelessly from the downhole tool to the sensor assembly for providing performance instructions to the sensor assembly.

Example 18 is the method for determining a performance status of an isolation barrier assembly downhole in a wellbore of example 11, further comprising: determining the status of the isolation barrier assembly by comparing the data collected by the sensor assembly to data collected by a sensor up-hole from a barrier of the isolation barrier assembly.

Example 19 is the method for determining a performance status of an isolation barrier assembly downhole in a wellbore of example 11, further comprising: setting the isolation barrier assembly via the downhole tool positioned up-hole to the isolation barrier assembly.

Example 20 is the method for determining a performance status of an isolation barrier assembly downhole in a wellbore of example 19, further comprising: decoupling the isolation barrier assembly from the downhole tool prior to transmitting the data related to the characteristic of the wellbore from the sensor assembly to the downhole tool positioned up-hole to the isolation barrier assembly.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A wellbore system for use downhole in a wellbore, the wellbore system comprising:

a running tool;

an isolation barrier assembly;

a sensor assembly coupled to the isolation barrier assembly via an adaptor, wherein the sensor assembly includes a sensor that is positionable downhole with respect to a seal of the isolation barrier assembly, wherein the isolation barrier assembly is positionable downhole between the running tool and the sensor assembly, and wherein the sensor assembly is in wireless acoustic telemetry communication with the running tool, wherein the running tool is configured for running the isolation barrier assembly downhole and setting the isolation barrier assembly, and wherein the running tool is configured to decouple from the isolation barrier assembly, and wherein the running tool comprises a wireless communications module for receiving data from the sensor assembly, and wherein the running tool further comprises a wired communication link for transmitting data received from the sensor assembly to a surface of the wellbore; and a computing device that is configured to determine the integrity of the seal of the isolation barrier based at least in part on the data collected by the sensor assembly, wherein the computing device is further configured to determine a performance status of the isolation barrier by comparing data collected by the sensor assembly to data collected by the sensor.

2. The wellbore system of claim 1, wherein the sensor assembly includes a battery pack for powering the sensor assembly.

3. The wellbore system of claim 1, wherein the isolation barrier assembly includes a connector for coupling to the running tool for supplying power to the sensor assembly via a power coupling connection.

4. The wellbore system of claim 3, wherein the connector is coupled to thru-lines for transmitting the power from the running tool to the sensor assembly.

5. The wellbore system of claim 1, wherein the running tool is in wireless communication with the sensor assembly for transmitting instructions to the sensor assembly.

6. The wellbore system of claim 1, wherein the sensor assembly includes an additional sensor for monitoring pressure.

7. The wellbore system of claim 1, wherein the running tool includes wireline or slickline.

8. A method for determining a performance status of an isolation barrier assembly downhole in a wellbore comprising:

positioning a running tool downhole, the running tool being coupled to the isolation barrier assembly, wherein the isolation barrier assembly is further coupled to a sensor assembly, wherein the sensor assembly is positioned downhole relative to the isolation barrier assembly;

setting, by the running tool, the isolation barrier assembly;

decoupling the running tool from the isolation barrier assembly;

collecting, via the sensor assembly, data related to a characteristic of the wellbore downhole from the isolation barrier assembly corresponding to an integrity of a seal of the isolation barrier assembly;

transmitting, by the sensor assembly, the data collected by the sensor assembly to the running tool positioned up-hole to the isolation barrier assembly via wireless acoustic telemetry, wherein the running tool comprises a wireless communications module for receiving data from the sensor assembly;

transmitting, by the running tool, the data collected by the sensor assembly to a surface of the wellbore; and determining the integrity of the seal of the isolation barrier based at least in part on the data collected by the sensor assembly; and determining the performance status of the isolation barrier assembly by comparing the data collected by the sensor assembly to data collected by a sensor up-hole from a barrier of the isolation barrier assembly.

9. The method for determining a performance status of an isolation barrier assembly downhole in a wellbore of claim 8, wherein the step of transmitting, by the sensor assembly, the data collected by the sensor assembly to the running tool positioned up-hole to the isolation barrier assembly via wireless acoustic telemetry further comprises transmitting the data via a wired communication link including slickline or wireline.

10. The method for determining a performance status of an isolation barrier assembly downhole in a wellbore of claim 8, further comprising:

transmitting power from the running tool to the sensor assembly via a connector within the isolation barrier assembly to which the running tool is coupled.

11. The method for determining a performance status of an isolation barrier assembly downhole in a wellbore of claim 10, wherein the step of transmitting power from the running tool to the sensor assembly via the connector within the isolation barrier assembly to which the running tool is coupled further comprises transmitting power from the running tool to the sensor assembly via a wet-stab connector.

12. The method for determining a performance status of an isolation barrier assembly downhole in a wellbore of claim 10, wherein the step of transmitting power from the running tool to the sensor assembly via the connector within the isolation barrier assembly to which the running tool coupled further comprises transmitting power from the running tool to the sensor assembly via a plurality of thru-wires positioned within an inner region of the sensor assembly.

13. The method for determining a performance status of an isolation barrier assembly downhole in a wellbore of claim 10, wherein the step of transmitting power from the running tool to the sensor assembly via the connector within the isolation barrier assembly to which the running tool coupled further comprises transmitting power from the running tool to the sensor assembly via a plurality of thru-wires positioned on an outer surface of the sensor assembly and covered by a housing.

14. The method for determining a performance status of an isolation barrier assembly downhole in a wellbore of claim 8, further comprising:

transmitting data wirelessly from the running tool to the sensor assembly for providing performance instructions to the sensor assembly.

15. The method for determining a performance status of an isolation barrier assembly downhole in a wellbore of claim 8, further comprising: decoupling the isolation barrier assembly from the running tool prior to transmitting the data related to the characteristic of the wellbore from the sensor assembly to the downhole tool positioned up-hole to the isolation barrier assembly.

* * * * *